US007757767B2

(12) United States Patent
Hill et al.

(10) Patent No.: US 7,757,767 B2
(45) Date of Patent: Jul. 20, 2010

(54) THROUGH TUBING GUN LOCK

(75) Inventors: Freeman L. Hill, Houston, TX (US); Randy L. Evans, Sugar Land, TX (US); Mark L. Sloan, Bellville, TX (US)

(73) Assignee: Baker Hughes Incorporated, Houston, TX (US)

( * ) Notice: Subject to any disclaimer, the term of this patent is extended or adjusted under 35 U.S.C. 154(b) by 84 days.

(21) Appl. No.: 12/043,542

(22) Filed: Mar. 6, 2008

(65) Prior Publication Data

US 2009/0223659 A1 Sep. 10, 2009

(51) Int. Cl.
*E21B 23/00* (2006.01)

(52) U.S. Cl. ..... 166/297; 166/212

(58) Field of Classification Search ..... 166/297, 166/382, 212

See application file for complete search history.

(56) References Cited

U.S. PATENT DOCUMENTS 2,749,841 A * 6/1956 Jones ..... 175/4.52
3,177,938 A 4/1965 Roussin
3,419,075 A * 12/1968 Brown ..... 166/383
4,415,029 A 11/1983 Pratt et al.
4,957,162 A 9/1990 Etourmy et al.
5,429,192 A 7/1995 Huber et al.
5,829,531 A 11/1998 Hebert et al.
6,152,233 A * 11/2000 Jani et al. ..... 166/382
6,315,043 B1 11/2001 Farrant et al.
6,629,568 B2 10/2003 Post et al.
6,651,747 B2 * 11/2003 Chen et al. ..... 166/382
6,926,087 B1 8/2005 Henke et al.
6,935,423 B2 8/2005 Kusmer

* cited by examiner

*Primary Examiner*—William P Neuder
(74) *Attorney, Agent, or Firm*—Bracewell & Giuliani LLP

(57) ABSTRACT

A lock for a perforating gun system comprising, a housing, a cylinder formed in the housing, a piston assembly disposed within the cylinder, and anchoring arms coupled with the piston assembly. Detonation of the shaped charges of an associated perforating gun produces a pressure surge which is communicated to a surface of the piston assembly. Appropriate movement of the piston assembly outwardly rotates the anchoring arms into anchoring engagement with an associated tubular. Thus the pressure from the detonation event will anchor a perforating system within its associated tubular.

20 Claims, 4 Drawing Sheets

THROUGH TUBING GUN LOCK

BACKGROUND

1. Field of Invention

The invention relates generally to the field of oil and gas production. More specifically, the present invention relates to a perforating system. Yet more specifically, the present invention relates to a locking device for anchoring a perforating gun system.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. In FIG. 1 an example of a perforating system 4 is shown. For the sake of clarity, the system 4 depicted comprises a single perforating gun 6 instead of a multitude of guns. The gun 6 is shown disposed within a wellbore 1 on a wireline 5. The perforating system 4 as shown also includes a service truck 7 on the surface 9, where in addition to providing a raising and lowering means, the wireline 5 also provides communication and control connectivity between the truck 7 and the perforating gun 6. The wireline 5 is threaded through pulleys 3 supported above the wellbore 1. As is known, derricks, slips and other similar systems may be used in lieu of a surface truck for inserting and retrieving the perforating system into and from a wellbore. Moreover, perforating systems may also be disposed into a wellbore via tubing, drill pipe, slick line, coiled tubing, to mention a few.

Included with the perforating gun 6 are shaped charges 8 that typically include a housing, a liner, and a quantity of high explosive inserted between the liner and the housing. When the high explosive is detonated, the force of the detonation collapses the liner and ejects it from one end of the charge 8 at very high velocity in a pattern called a "jet" 12. The jet 12 perforates the casing and the cement and creates a perforation 10 that extends into the surrounding formation 2.

Generally the wellbore pressure is different from the pressure within the formation 2, thus upon perforation pressure equalization occurs between the formation and the wellbore which in turn produces either flow into the wellbore from the formation, or into the formation from the wellbore. When the wellbore pressure is greater than the formation pressure this is known as an overbalanced situation, whereas when the formation pressure exceeds the wellbore pressure is known as an underbalanced situation. Many times when the perforating guns are detonated, the forces applied to the perforating guns are not balanced and can produce a resultant force that thrusts the perforating gun suddenly upward or downward upon detonation. This can be exacerbated in an overbalanced or underbalanced condition.

SUMMARY OF INVENTION

Disclosed herein is a locking system for anchoring a perforating gun assembly within a tubular comprising, a housing, a cylinder formed in the housing and in pressure communication with the perforating gun assembly, a piston assembly coaxially disposed in the cylinder, and an anchoring arm responsive to piston assembly movement and configured to engage the tubular with movement of the piston assembly in a first direction, wherein activating the perforating gun assembly pressurizes the cylinder and urges the piston assembly within the cylinder in a first direction thereby anchoring the locking system in the tubular.

The locking system may further comprise a bore formed adjacent to and coaxial with the cylinder. A piston assembly may be included having a piston with a first and second side wherein the first side is in pressure communication with the perforating gun assembly, a piston rod extending from the piston second side, and a shaft coaxially disposed in the bore and connected to the end of the piston rod. The locking system may further comprise a passage extending between the cylinder and the perforating assembly or a port formed through the housing to the cylinder. A resilient member may be included with the system, where the member is in coaxial engagement with the piston assembly disposed on the side of the piston assembly wherein movement of the piston assembly in the first direction stores potential energy in the resilient member. The resilient member can be used to reposition the piston into its original position. The tubular in which the locking system is used may be tubing or casing.

An optional locking device for anchoring a downhole tool within a tubular in a wellbore comprises a housing, an anchoring member selectively pivotable away from the housing into locking engagement with the tubular, and a deployment apparatus configured to pivot the anchoring member into locking engagement with the tubular in response to a pressure rise in the wellbore. The deployment apparatus includes a cylinder formed in the housing, a piston assembly coaxially slideable within the cylinder and pivotingly linked to the anchoring member, and a pressure communication passage formed between the cylinder and the housing outer surface. The piston may be configured to slide within the cylinder in response to the wellbore pressure rise and pivot the anchoring member into locking engagement with the tubular.

The present disclosure further considers a perforating system disposable within a downhole tubular. The perforating system comprises a perforating gun assembly with shaped charges, an initiation system in communication with the shaped charge, an anchoring sub connected with the perforating gun assembly, and an anchoring arm hinged on an end to the anchoring sub and selectively pivotable into anchoring contact with the tubular in response to a pressure increase produced by shaped charge detonation. The perforating system may optionally further comprise a piston assembly pivotingly attached to the anchoring arm, wherein the piston assembly is moveable by the pressure increase. The portion of the anchoring arm engaging the tubular can be formed in a cam profile for enhancing anchoring.

BRIEF DESCRIPTION OF DRAWINGS

Some of the features and benefits of the present invention having been stated, others will become apparent as the description proceeds when taken in conjunction with the accompanying drawings, in which.

Figure 1:
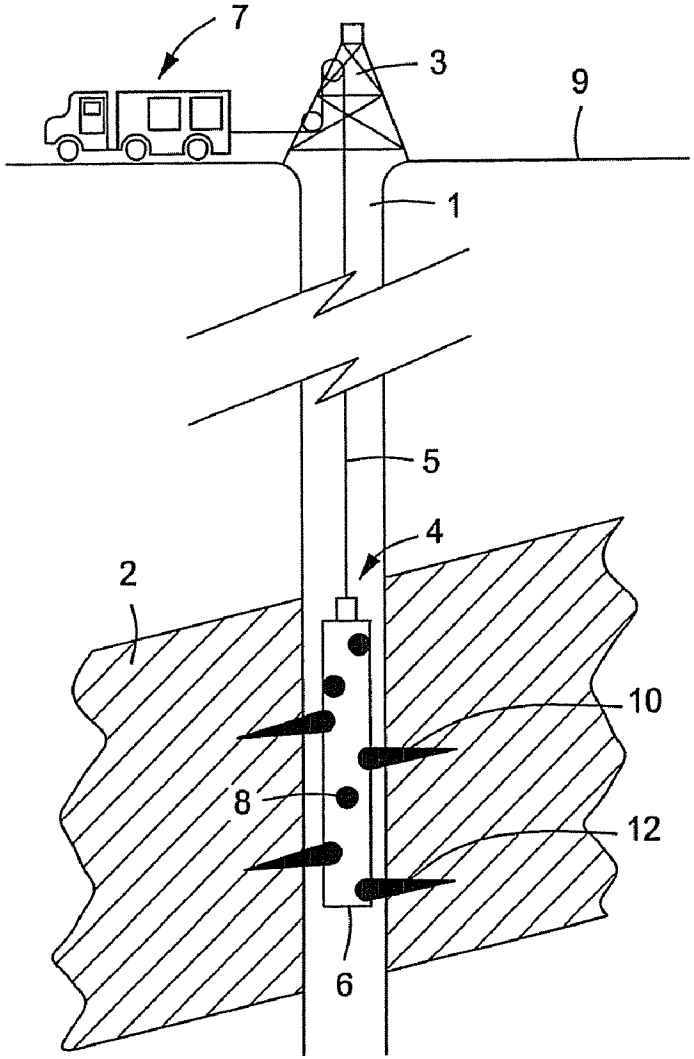
FIG. 1 is partial cutaway side view of a perforating system in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

Disclosed herein is a locking system for downhole tools, such as perforating guns, responsive to surges in wellbore pressure. In one embodiment, the locking assembly is responsive to the pressure surge produced during a perforating sequence. The locking assembly includes linkage for transferring the increased pressure to mechanical movement, which moves locking arms into engagement with a tubular, and wherein the configuration of the locking arms produces additional resistive forces with increased upward urging of the tool within the wellbore.

Figure 2B:
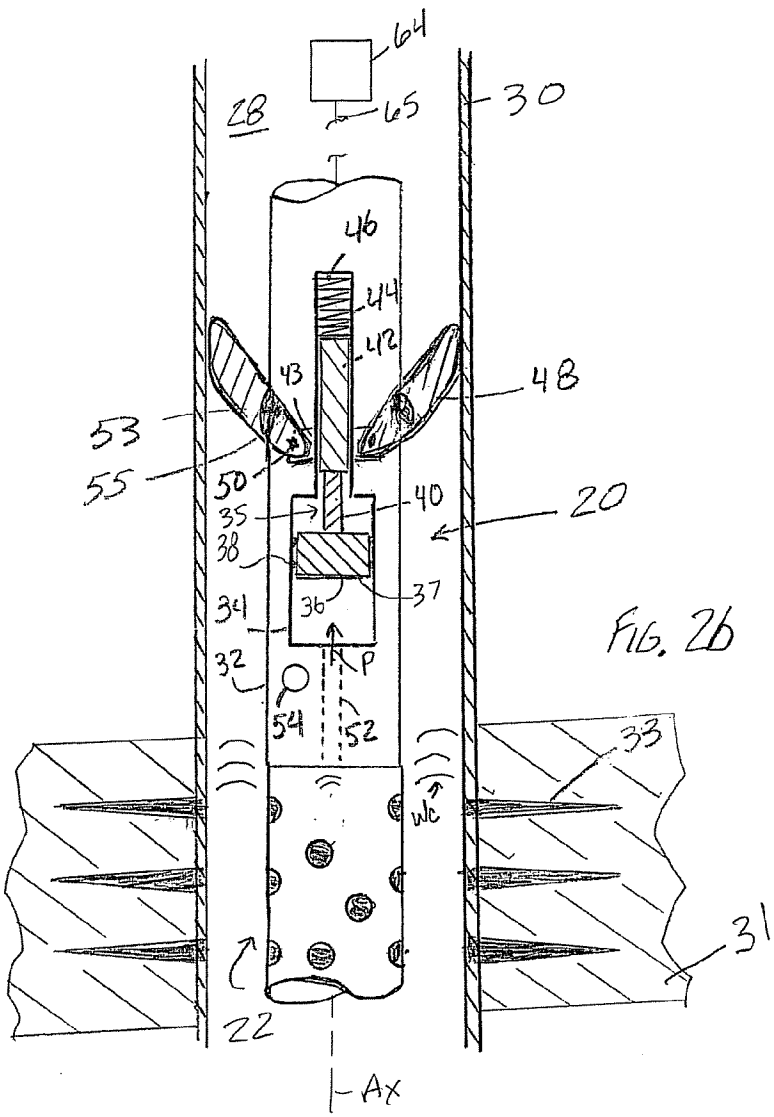
FIGS. 2*a* and 2*b* illustrate partial cutaway side views of an embodiment of a lock for a perforating gun.
Figure 2A:
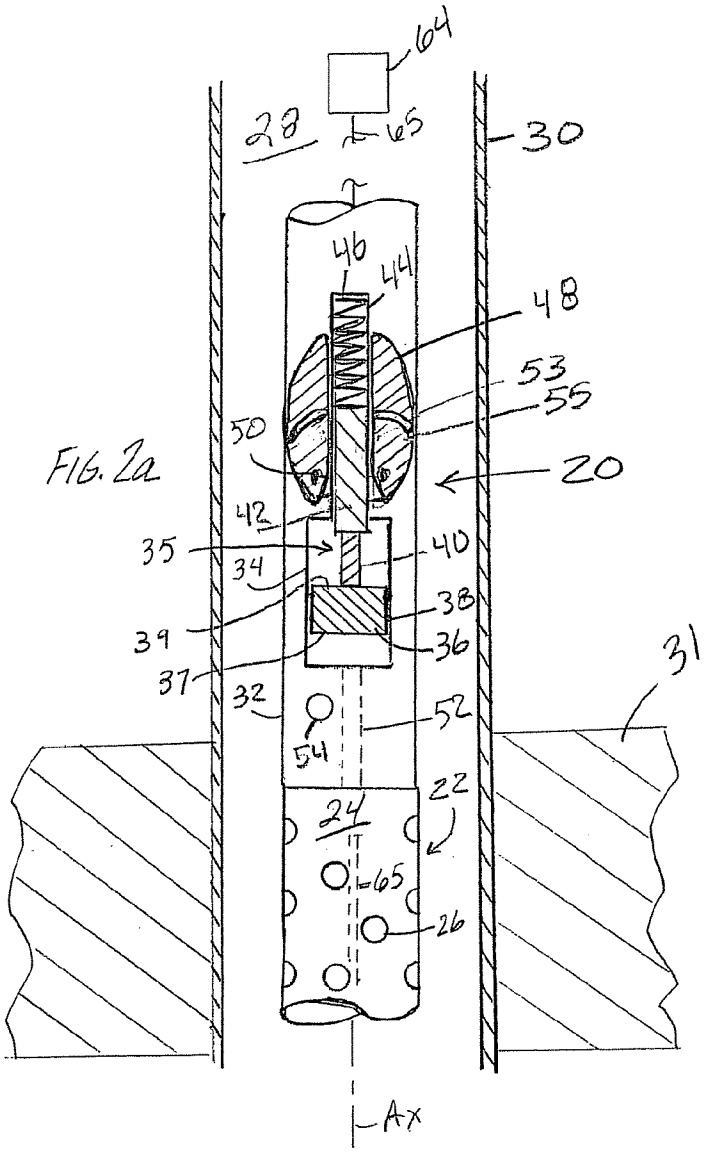

With reference now to FIG. 2*a*, one embodiment of a gun lock assembly 20 is provided in a side partial cutaway view. Here the gunlock assembly 20 has a perforating gun 22 connected to lower section. The perforating gun 22 comprises a gun body 24 having shaped charges 26 disposed within the gun body 24 connected to a detonation cord 65. The gun lock assembly 20 and perforating gun 22 are coaxially disposed within a tubular member. In the embodiment of FIG. 2*a* the tubular member is a casing 30 used in lining a hydrocarbon producing wellbore 28.

With reference now to FIG. 2*a*, the gunlock assembly 20 comprises an elongated housing 32 having a cylinder 34 longitudinally formed therein. A piston assembly 35 is shown coaxially disposed within the cylinder 34 and configured for up and down axial movement within the cylinder 34. The piston assembly 35 includes a piston 36 on its lower end having a piston rod 40 extending from its upper end and connecting to a shaft 42. Optional seals 38 may be included on the outer periphery of the piston 36 thereby pressure sealing the lower surface 37 of the piston 36 from its upper surface 39. As will be described in more detail below, the piston lower surface 37 will be subjected to an increased pressure. Thus to ensure axial responsive movement of the piston 36 within the cylinder 34 due to the increased pressure, it is important to pressure isolate the lower surface 37 from the upper surface 39.

A bore 44 extends from the upper terminal end of the cylinder 34 within the housing 32, where the bore 44 is generally coaxial with the cylinder 34. In the embodiment of FIG. 2*a*, the bore 44 diameter is less than the cylinder 34 diameter. The bore 44 is formed to coaxially receive the shaft 42 therein and allow for up and down movement within the bore 44. A spring 46 is disposed in the bore 44 and in forcible contact with the upper terminal end of the shaft 42 and thus disposed to provide compressed spring force on the upper end of the piston assembly 35. Anchor arms 48 are provided on the housing 32, the arms 48 as shown have an elongated configuration generally parallel with the bore 44. In the embodiment of FIGS. 2*a* and 2*b*, the anchor arms 48 are coupled to the piston assembly 35 through pins 50 extending through apertures 51, wherein the apertures 51 are formed through the body of the anchor arm 48. However the scope of the present disclosure is not limited to the pivotingly connected coupling of FIGS. 2*a* and 2*b*, but includes other manners of coupling the arms 48 and the piston assembly 35. As discussed in more detail below, coupling includes sliding contact between the assembly and arm where the arm rotates about a set pin, and corresponding teeth disposed on the assembly and arm that are intermeshed.

An initiator 64 with associated detonation cord 65 is provided in schematical view in FIGS. 2*a* and 2*b*. The initiator 64 may be included downhole with a perforating system or at surface, the initiator 64 is used for initiating an explosive signal through the detonation cord 65 which is transferred to the shaped charges 26 of the perforating gun 22 for detonating the shaped charges 26. With reference now to FIG. 2*b* the gun lock assembly 20 of FIG. 2*a* is shown in a deployed position which is in response to a pressure increase in the wellbore. The pressure increase may be caused by a pressure wave from detonation of the shaped charges 26 or the detonation cord 65. As shown, the shaped charge 26 detonation produced corresponding perforations 33 through the casing 30 and into the formation 31 surrounding the wellbore 28. Shaped charge 26 detonation produces a pressure increase in the wellbore 28 represented by the compressional waves $W_C$ shown migrating from adjacent the perforating gun 22 and into the gun lock assembly 20. This pressure increase is communicated to the gun lock assembly 20 either through the mid section of the perforating gun 22 in the corresponding passage 52, thereby communicating pressure to the cylinder 34. Optionally, a port or inlet 54 may be provided on the gun lock assembly housing 32, wherein the port 54 is in pressure communication with the cylinder 34. An optional rupture disk (not shown) may be disposed within the gun lock assembly 20 separating the port 54 and/or passage 52 from the cylinder 34 for isolating the cylinder 34 from wellbore fluids or other contaminants prior to shaped charge 26 detonation.

In one mode of operation, the pressure from detonation of the shaped charge 26 or detonation cord 65, represented by the arrow P travelling through the passage 52, enters into the cylinder 34 and communicates with the first side 37 of the piston 36. Pressurizing the cylinder 34 on the first side 37 of the piston 36 produces a pressure differential across the piston 36. The pressure differential may be maintained by the seals 38 on the piston 36 outer periphery. This pressure differential urges the piston assembly 35 upward within the housing 32 of the gun lock assembly 20.

The anchor arms 48 embodiment illustrated in FIGS. 2*a* and 2*b* is hingingly and pivotingly affixed to the piston assembly 35 through the pin 50 and aperture 51 on elements 43 that extend lateral from the shaft 42. Accordingly upward movement of the piston assembly 35 pushes the pin 50 upward. A slot pin 55 is set within the housing 32, an elongated curved slot 53 provided through the body of the arm 48 receives the slot pin 55 therein. Upwardly moving the arm 48 (by its coupling with the piston assembly 35 via the pin 50 and aperture 51) produces rotation of the arms 48 radially away from the housing 32 slides the slot pin 55 within the slot 53 from a first position 57 to a second position. Radially disposing the arms 48 outward pushes them from a stowed or running position adjacent or within the housing 32 and into engaging contact with the inner surface of the casing 30. Although shown as casing 30, the gun lock assembly 20 and associated perforating gun 22 of the present embodiment can also be deployed and used within other tubulars, such as production tubing or completion sections. By radially and rotatingly outwardly urging the arms 48 into engaging contact with the inner circumference of the casing 30, the gun lock assembly 20 secures the perforating gun 22 and other associated hardware within the casing 30 and prevents further upward movement of these devices.

Figure 5B:
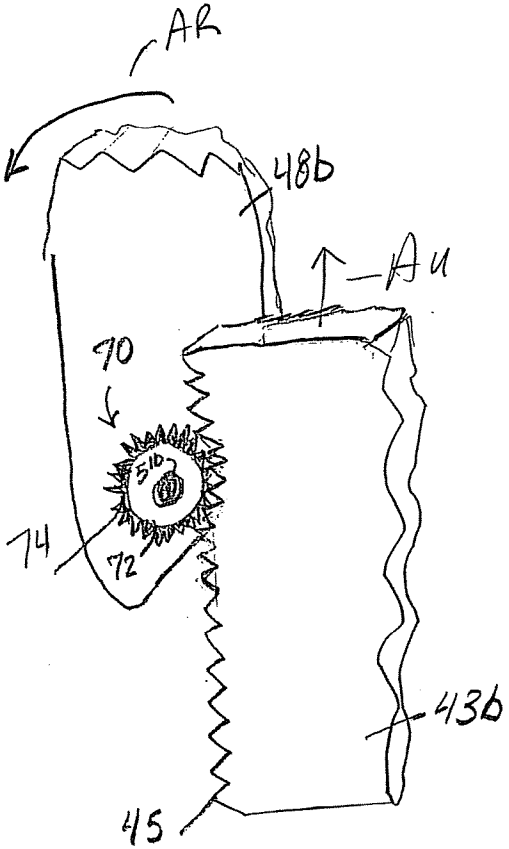
FIGS. 5*a* and 5*b* are perspective views of alternative assemblies for putting the anchoring arm into anchoring engagement.
Figure 5A:
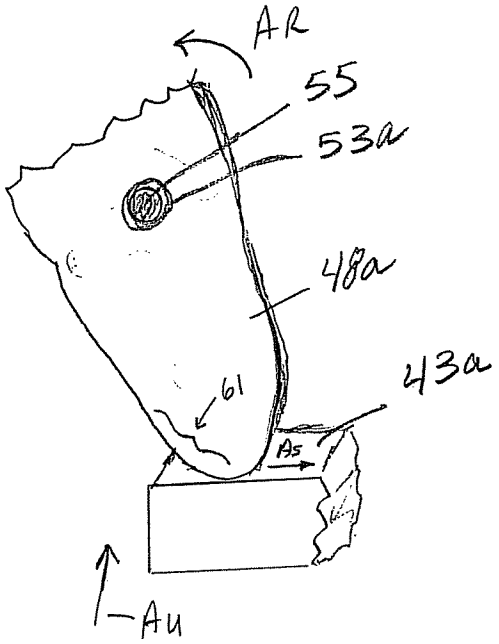

FIGS. 5*a* and 5*b* provide alternative embodiments demonstrating how the piston assembly 35 is coupled with the anchoring arm and how these anchoring arm embodiments respond to piston assembly 35 movement and engage the tubular. Referring now to FIG. 5*a*, a portion of the element 43*a* is illustrated coupled with the anchoring arm 48*a* on a lower surface. The element 43*a* is not mechanically affixed to the arm 48*a*, the element 43*a* contacts the arm 48*a* along its lower lateral surface 61. In one example of use, as the element 43*a* moves upward (as illustrated by arrow $A_U$) in response to piston assembly 35 upward movement, it pushes on the lower lateral surface 61 causing the arm 48*a* to slide inward on the element 43*a* across its lower lateral surface 61. This sliding action, in the direction represented by arrow $A_s$, rotates the arm 48*a* radially outward as illustrated by arrow $A_R$. The arm 48*a* pivots about slot pin 55 inserted through the slot 53. The slot pin 55 is freely inserted through the slot 53 thereby allowing the arm 48*a* to freely pivot and rotate with respect to the slot pin 55. The outward radial rotation urges the arm 48*a* into anchoring engagement with the tubular.

The coupling assembly displayed in FIG. 5*b* provides an engagement wheel 70 affixed to the lateral surface of the arm 48*b*. The wheel 70 has a generally cylindrically shaped body 72 coplanar with the lateral side of the arm 48*b*. Teeth 74 are on the outer radial surface of the body 72. In the embodiment of the element 43*b* of FIG. 5*b*, corresponding teeth 45 are provided on an outer lateral edge of the element 43*b* and formed for engagement with the teeth 74 on the wheel 70. When the element 43*b* is moved upward, as illustrated by arrow $A_U$, its lateral upward force is translated into a radial force onto the wheel 70 by its interaction with the wheel teeth 74. The translated radial force rotates the arm 48*b* outward as shown by arrow $A_R$ from the running position into anchoring deployment. The arm 48*b* may pivot about a pivot pin (not shown) extending through the arm 48*b* and coaxial with the wheel 70. Subsequent downward movement of the element 43*b*, will draw the arm 48*b* from the deployed position back into the running or stowed position by interaction of the intermeshed teeth (45, 74).

The upward urging of the piston assembly 35 forces the shaft 42 into the bore 44 compresses the spring 46 storing potential energy in the spring 46. Upon cessation of the increased pressure from the shaped charge detonation, the potential energy stored in the spring 46 acts on the upper end of the shaft 42 to urge the piston assembly 35 downward into its original position proximate to the lower portion of the cylinder 34. Due to the pivoting and hinged connection between the piston assembly 35 and the arms 48, the downward movement of the piston assembly 20 draws the arms 48 back into substantial parallel alignment with the housing 32.

The spring 46 potential energy is released to reposition the arms 48 from a deployed anchoring position into a passive "running" position. In the running position, the arms are out of engaging position with the tubular thereby allowing free passage of the gun lock assembly 20 and perforating gun 22 within an associated tubular. It should be pointed out that other means may be employed for repositioning the arms 48 into the running position, such as a resilient member disposed in the bore 44. Optionally, the bore 44 may be filled with a compressible gas and seals placed around the outer peripheral surface of the shaft 42 thus using the compressing the gas to store energy and then allowing the gas to expand and retract the arms 48 into a passive running position from a deployed anchoring position.

Figure 3:
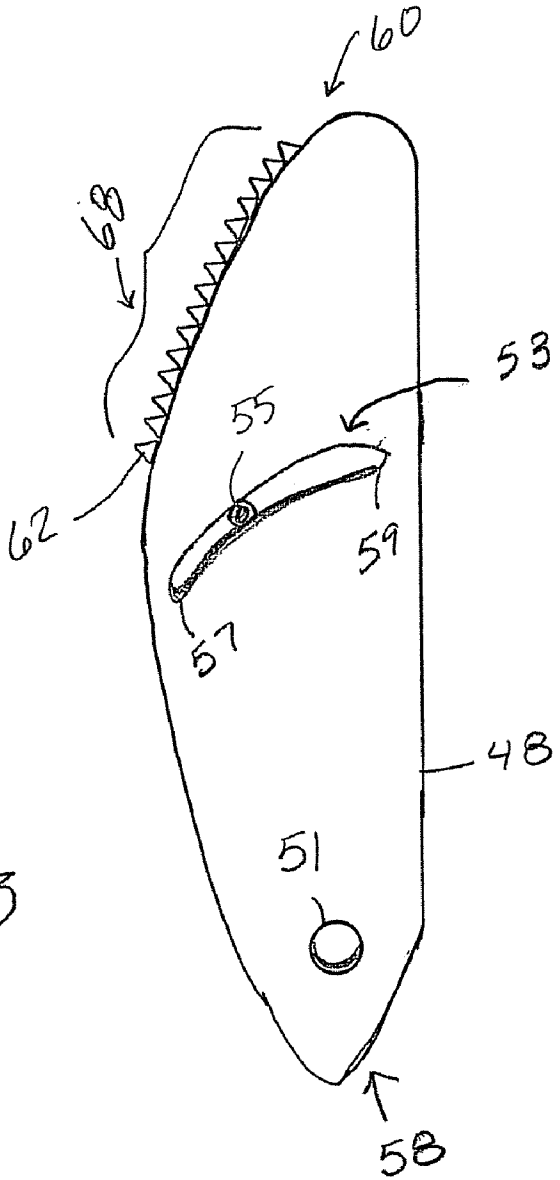
FIG. 3 is a side view of an embodiment of an anchoring arm.

With reference now to FIG. 3 a side view of an embodiment of an anchor arm 48 is provided. A lower shoulder 58 is defined by the outer peripheral surface of the arm 48, where the lower shoulder 58 may come into sliding contact with the lateral side of the shaft 42 during deployment and retraction of the arms 48. To facilitate a better sliding action, the lower shoulder 58 should be made from a substantially smooth surface. Optionally, the lower shoulder 58 may be coated with a low friction material such as teflon or other compositions having a low coefficient of friction. On the upper portion 60 of the anchor arm 38 is an engaging surface 68, wherein the engaging surface 68 defines the surface of the anchor arm 48 likely to engage the tubular during the anchoring sequence of the gun lock assembly 20. To enhance anchoring of the gun lock assembly 20, raised elements 62 may be provided on the entire area of the engaging surface 68 or a portion of the engaging surface 68. These raised elements 62 can take on any of a number of shapes or combinations of shapes. The raised elements 62 are shown in FIG. 3 as triangular shaped teeth having a pointed outer edge for an enhanced gripping action, however surfaces may include grooves or ridges. Optionally the engaging surface 68 may be impregnated with hard materials such as diamonds.

Figure 4:
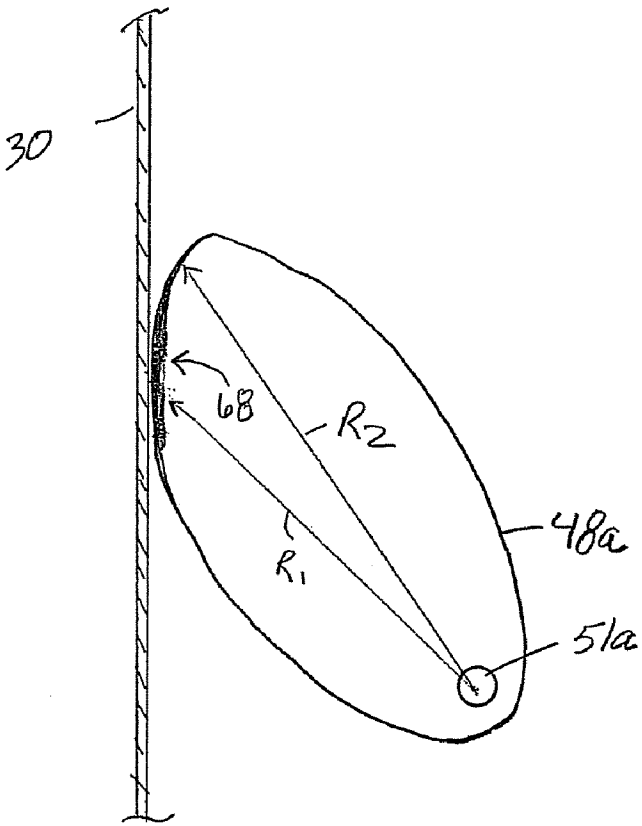
FIG. 4 is a side view of an embodiment of an anchoring arm engaging a tubular.

FIG. 4 illustrates an embodiment of an anchor arm 38*a* having a cammed configuration. In this configuration the contour of the engaging surface 68 is such that the arm radius will increase with increased force upwardly motivating the gun lock assembly 20. For example, initial deployment of the arm 48*a* will produce engagement between the casing 30 and the engaging surface at a point on the arm represented by $R_1$. Further upward movement of the gun lock assembly 20 and perforating gun 22 produces additional outward pivoting of the arm 48*a* thereby contacting the point on the engaging surface 68 represented by radius $R_2$ with the casing 30. Since $R_2$ exceeds the length of $R_1$, the shape of the arm 48*a* provides added compressive force as attempts are made to further urge the gun lock assembly 20 upward within the wellbore 28. This is an additional feature that enhances the locking of the gun within the wellbore thereby preventing movement in a particular location.

It should be pointed out that in some instances underbalanced conditions may move a perforating gun in a downward direction after shaped charge detonation. Accordingly, the device described herein can be adjusted to prevent downward movement as well. Optionally, a perforating gun string, or other downhole assembly, may employ multiple gun lock assemblies within the string wherein the assemblies may be deployed in the same orientation thereby preventing vertical wellbore movement in a single direction, or in opposing orientations to thus provide for anchoring in response to movement in more than one direction.

Operation of the gun lock assembly described herein, is not limited to pressures due to perforating gun detonation, however can be activated from surges in pressure from other sources. Additionally, the gun lock assembly 20 includes embodiments comprising a single anchor arm as well as more than two anchor arms. Additionally, the anchor arms may be disposed symmetric about the axis of the housing 32, and also may be asymmetric. The asymmetry may be at different vertical elevations from one another along the housing axis, or at different radial locations about the housing axis. The other downhole tools that may be used with the gun lock assembly 20.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is.

1. A locking system for anchoring a perforating gun assembly within a tubular, the system comprising:

a housing;

a cylinder formed in the housing and in pressure communication with the perforating gun assembly;

a piston assembly coaxially disposed in the cylinder; and an anchoring arm coupled with the piston assembly and configured to engage the tubular in response to piston assembly movement in a first direction, wherein activating the perforating gun assembly pressurizes the cylinder and urges the piston assembly within the cylinder in the first direction thereby anchoring the locking system in the tubular.

2. The locking system of claim 1 further comprising another anchoring arm.

3. The locking system or claim 1 further comprising a bore formed adjacent to and coaxial with the cylinder.

4. The locking system of claim 3, wherein the piston assembly comprises a pistion in having a first and second side wherein the first side is in pressure communication with the perforating gun assembly, a piston rod extending from the piston second side, and a shaft coaxially disposed in the bore and connected to the end of the piston rod.

5. The locking system of claim 1, further comprising raised members formed on the surface of the anchoring arm engaged with the tubular.

6. The locking system of claim 1 further comprising a passage extending between the cylinder and the perforating assembly.

7. The locking system of claim 1 further comprising at port formed through the housing to the cylinder.

8. The locking system of claim 1 further comprising a resilient member in coaxial engagement with the piston assembly disposed on the side of the piston assembly wherein movement of the piston assembly in the first direction stores potential energy in the resilient member.

9. The locking system of claim 8, wherein the resilient member urges the piston assembly in a second direction opposite the first direction upon cessation of cylinder pressurization.

10. The locking system of claim 1 wherein the tubular is selected from the list consisting of tubing and casing.

11. The locking system of claim 1, wherein the piston assembly is coupled to the anchoring arm with an assembly selected from the list consisting of a pivot pin in the piston assembly freely inserted through a slot in the locking arm and teeth on the anchoring arm intermeshed with corresponding teeth on the piston assembly.

12. The locking system of claim 1, further comprising a pivot pin about which the anchoring arm is rotatable, wherein a portion of the piston assembly is in contacting engagement with an outer surface of the anchoring arm such that movement of the piston assembly rotates the anchoring arm about the pivot pin and into anchoring engagement with the tubular.

13. The locking system of claim 1, wherein the perforating gun assembly comprises shaped charges and detonation cord, and wherein detonation of the shaped charges or detonation cord pressurizes the cylinder to move the piston.

14. A locking device for anchoring a downhole tool within a tubular in a wellbore, the locking device comprising:

a housing;

an anchoring member selectively pivotable into locking engagement with the tubular; and a deployment means comprising a cylinder formed in the housing, a piston assembly coaxially slideable within the cylinder and pivotingly linked to the anchoring member, and a pressure communication passage formed between the cylinder and the housing outer surface, so that when pressure in the wellbore rises, a pressure differential forms across the piston to slide the piston within the cylinder to pivot the anchoring member into locking engagement with the tubular.

15. The locking device of claim 14 further comprising another anchoring member selectively deployable into locking engagement with the tubular.

16. The locking device of claim 14 wherein the downhole tool comprises a perforating gun.

17. The locking device of claim 14 further comprising a resilient member arranged to push the piston assembly to its original position when the pressure rise has ceased.

18. The locking device or claim 14 further comprising raised elements on the engagement surface of the anchoring member.

19. A perforating system disposable within a downhole tubular comprising:

a perforating gun assembly comprising shaped charges;

an initiation system in communication with the shaped charge;

an anchoring sub connected with the perforating gun assembly;

an anchoring arm hinged on an end to the anchoring sub; and a piston assembly pivotingly attached to the anchoring arm, wherein the piston assembly is moveable by a pressure increase by shaped charge detonation to selectively pivot the anchoring arm into anchoring contact with the tublar.

20. The perforating system of claim 19, wherein the portion of the anchoring arm engaging the tubular has a cam profile for enhancing anchoring.

* * * * *